US008907934B2

(12) United States Patent
Wu et al.

(10) Patent No.: US 8,907,934 B2
(45) Date of Patent: Dec. 9, 2014

(54) PIXEL ARRAY SUBSTRATE AND DISPLAY PANEL USING THE SAME

(75) Inventors: Chi-Ming Wu, Hsinchu (TW); Chun-Ta Chien, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 150 days.

(21) Appl. No.: 13/561,114

(22) Filed: Jul. 30, 2012

(65) Prior Publication Data

US 2013/0176290 A1 Jul. 11, 2013

(30) Foreign Application Priority Data

Jan. 5, 2012 (TW) ..... 101100513 A

(51) Int. Cl.
*G09G 5/00* (2006.01)

(52) U.S. Cl.
USPC ..... 345/206

(58) Field of Classification Search
USPC ..... 345/206, 204
See application file for complete search history.

(56) References Cited

U.S. PATENT DOCUMENTS 6,812,909 B1 * 11/2004 Crossland ..... 345/89
7,257,007 B2 * 8/2007 Wilkinson et al. ..... 361/788
7,777,821 B2 * 8/2010 Ota ..... 349/39
2010/0283721 A1 11/2010 Wang et al.
2011/0080384 A1 4/2011 Liu et al.

FOREIGN PATENT DOCUMENTS

CN 1624735 A 6/2005
CN 101256332 A 9/2008
TW 201108176 A1 3/2011

OTHER PUBLICATIONS

China Patent Office, "Office Action", Aug. 26, 2014.

* cited by examiner

*Primary Examiner* — Fred Tzeng
(74) *Attorney, Agent, or Firm* — WPAT, PC; Justin King

(57) ABSTRACT

A pixel array substrate includes a substrate, a plurality of center pixel units, a plurality of edge pixel units, at least one conductive pattern, at least one passive electrode and a driving circuit. The substrate includes a main display area and a sub-display area around the main display area. The center pixel units and the edge pixel units are arrayed in the main display area. The conductive pattern and the passive electrode are disposed in the sub-display area, and the conductive pattern is electrically connected to the driving circuit and the passive electrode. The driving circuit is electrically connected to the edge pixel units and the passive electrode and configured to output a plurality of edge pixel signals to the edge pixel units and the passive electrode. A display panel using the pixel array substrate is provided. The pixel array substrate and the display panel have an advantage of increasing display area.

17 Claims, 2 Drawing Sheets

PIXEL ARRAY SUBSTRATE AND DISPLAY PANEL USING THE SAME

TECHNICAL FIELD

The present disclosure relates to displays, and more particularly to a pixel array substrate and a display panel using the same.

BACKGROUND

With the development of technology, display panels are widely applied to various electrical devices. Each display panel includes a main display area. Generally, the main display area is rectangular. However, sometimes, the main display area is not rectangular, and there are some irregular blocks at edges of the main display area. Usually, these irregular blocks are omitted and do not show any images. Otherwise, a complicated combined matrix is designed to make the irregular blocks show images, so that the main display area can sufficiently show a picture.

On one hand, if the irregular blocks fail to show images, the display area of the display panel will be reduced. On another hand, the complicated combined matrix will increase the manufacture cost of the display panel. In addition, even conventional display panels do not have above problem, in a state of the size of the display panel being unchanged, it is hard to increase the display area to improve the visual effect of the display panel.

SUMMARY

An embodiment of the present disclosure provides a pixel array substrate including a substrate, a plurality of center pixel units, a plurality of edge pixel units around the center pixel units, at least one conductive pattern, at least one passive electrode and a driving circuit. The substrate includes a main display area and a sub-display area around the main display area. The center pixel units and the edge pixel units are arrayed in the main display area. The passive electrode is disposed in the sub-display area and surrounds the edge pixel units. The driving circuit is disposed in the sub-display area and is electrically connected to the center pixel units and the edge pixel units. The conductive pattern is disposed in the sub-display area and is electrically connected to the passive electrode and the driving circuit. The driving circuit is configured to output a plurality of edge pixel signals to the edge pixel units and the passive electrode.

An embodiment of the present disclosure further provides a display panel including the above-mentioned pixel array substrate, a transparent substrate and a display medium layer. The transparent substrate is disposed above the pixel array substrate. The display medium layer is disposed between the pixel array substrate and the transparent substrate.

BRIEF DESCRIPTION OF THE DRAWINGS

The present disclosure will become more readily apparent to those ordinarily skilled in the art after reviewing the following detailed description and accompanying drawings, in which.

DETAILED DESCRIPTION OF PREFERRED EMBODIMENTS

The pixel array substrate and the display panel of the present disclosure will now be described more specifically with reference to the following embodiments accompanying drawings. It is to be noted that the number of the center pixel units, the edge pixel units, the passive electrode and the driving circuit of the pixel array substrate of preferred embodiments of this disclosure are presented herein for purpose of illustration and description only. It is not intended to be exhaustive or to be limited to the precise form disclosed.

Figure 1:
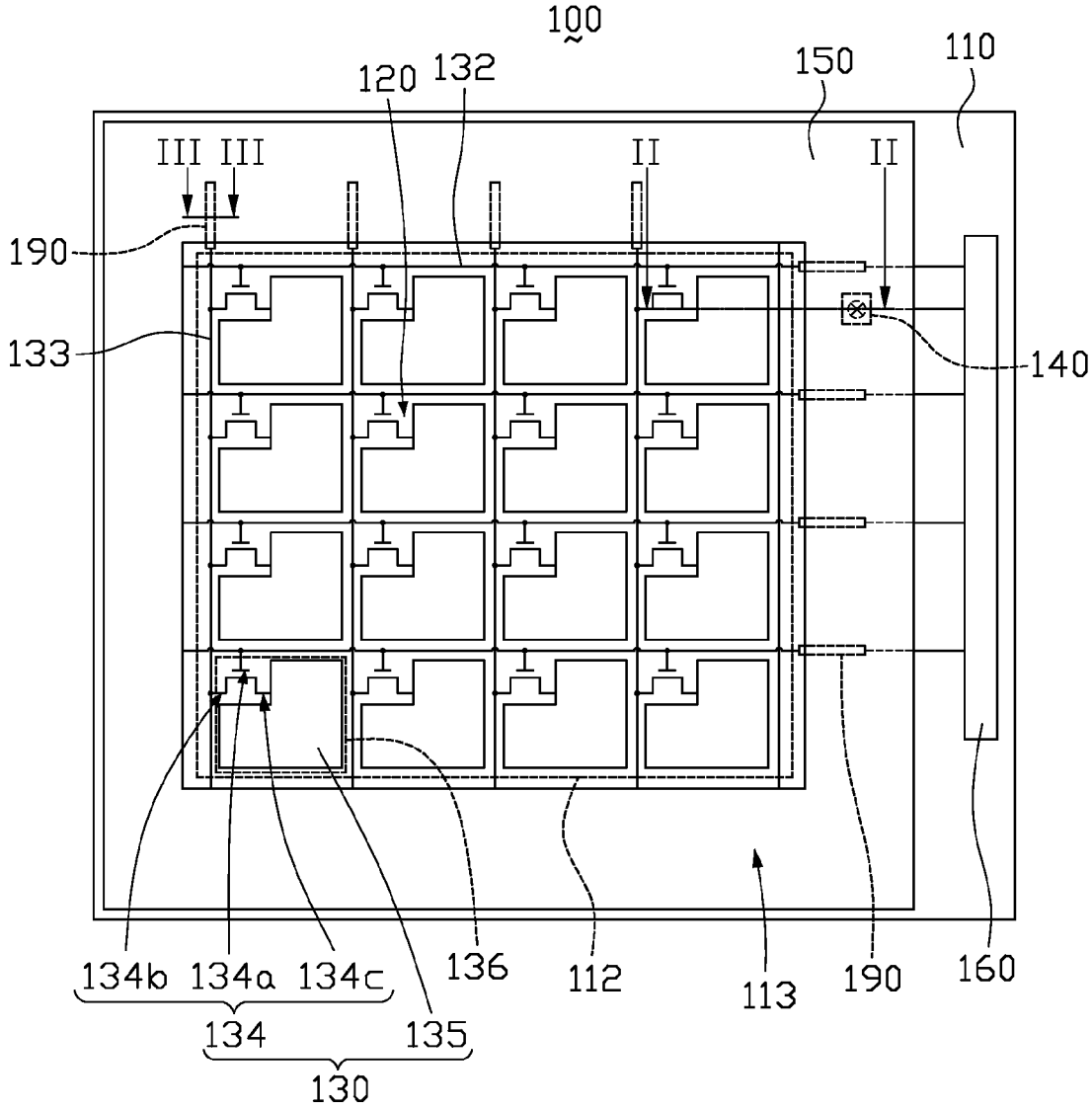
FIG. 1 is a schematic view of a pixel array substrate according to an embodiment of the present disclosure.
Figure 2:
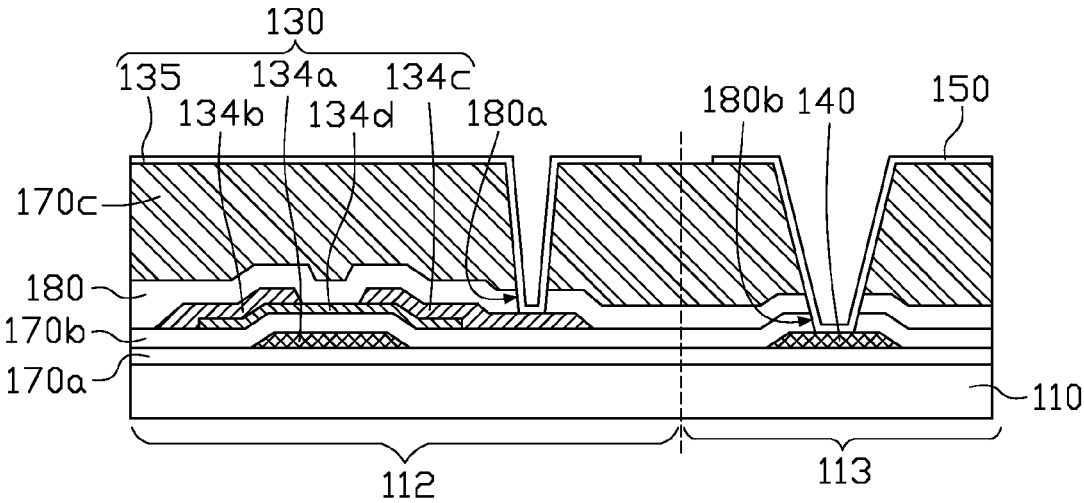
FIG. 2 is a schematic cross-sectional view taken along line II-II of FIG. 1.

FIG. 1 is a schematic view of a pixel array substrate according to an embodiment of the present disclosure. FIG. 2 is a schematic cross-sectional view taken along line II-II of FIG. 1. Referring to FIGS. 1 and 2, the pixel array substrate 100 includes a substrate 110, a plurality of center pixel units 120, a plurality of edge pixel units 130, at least one conductive pattern 140, at least one passive electrode 150 and a driving circuit 160. FIG. 1 shows four center pixel units 120 and twelve edge pixel units 130 around the center pixel units 120. However, the numbers of the center pixel units 120 and the edge pixel units 130 are not limited.

The substrate 110 includes a main display area 112 and a sub-display area 113 around the main display area 112. The center pixel units 120 and the edge pixel units 130 are arranged in the main display area 112 in array. A plurality of parallel scanning lines 132 and a plurality of parallel data lines 133 are formed in the main display area 112. The scanning lines 132 and the data lines 133 are intersected to define a plurality of pixel regions 136 in the main display area 112. The center pixel units 120 and the edge pixel units 130 are respectively disposed in the corresponding pixel regions 136. Each edge pixel unit 130 includes an active element 134 and a pixel electrode 135. The active element 134 is disposed adjacent to an intersection of the corresponding scanning line 132 and the corresponding data line 133, and is electrically connected to the corresponding scanning line 132 and the corresponding data line 133. The pixel electrode 135 is electrically connected to the active element 134. More specifically, the active element 134 may be a thin film transistor, including a gate 134*a*, a source 134*b* and a drain 134*c*. The gate 134*a* is electrically connected to the corresponding scanning line 132. The source 134*b* is electrically connected to the corresponding data line 133. The drain 134*c* is electrically connected to the corresponding pixel electrode 135.

In this embodiment, the detail configuration of the center pixel unit 120 is similar to the edge pixel unit 130. The difference between the center pixel unit 120 and the edge pixel unit 130 just is position arrangement. Thus, the detail configuration of the center pixel unit 120 is not described here.

The conductive pattern 140, the passive electrode 150 and the driving circuit 160 are disposed in the sub-display area 113. The passive electrode 150 surrounds the edge pixel units 130. The driving circuit 160 may be electrically connected to the center pixel units 120, the edge pixel units 130 and the passive electrode 150 through a flexible circuit board (not shown), and configured to output a plurality of edge pixel signals to the edge pixel units 130 and the passive electrode 150. The conductive pattern 140 is positioned between and electrically connected to the driving circuit 160 and the passive electrode 150 respectively, and configured to transmit the edge pixel signal from the driving circuit 160 to the passive electrode 150.

In this embodiment, the conductive pattern 140 may be, but not limited to, formed with the scanning lines 132 and the gate 134*a* in a same process. However, in other embodiments, the conductive pattern 140 may be formed with the data lines 133, the source 134*b* and the drain 134*c* in a same process. In addition, the passive electrode 150 may be formed with the pixel electrode 135 in a same process, so that the passive electrode 150 and the pixel electrode 135 has the same material, e.g., indium tin oxide (ITO), indium zinc oxide (IZO) or other transparent metal oxide. In other embodiments, the passive electrode 150 can be a non-transparent conductor, for example, metal.

Due to the conductive pattern 140, the driving circuit 160 can output the edge pixel signals to the edge pixel units 130 and the passive electrode 150 at the same time, so that the pixel electrodes 135 of the edge pixel units 130 have substantially the same voltage to the passive electrode 150. Thus, an area corresponding to the passive electrode 150 can show substantially the same grey level with the edge pixel units 130, which is beneficial to expand the display area of the substrate 110.

A method for manufacturing the pixel array substrate 100 is described accompanying FIG. 2. To be brief, FIG. 2 does not show the center pixel units 120 in FIG. 1, since it should be known for one skilled in this field that the center pixel unit 120 does not only has a similar configuration to the edge pixel unit 130, but also has a similar manufacture process to the edge pixel unit 130. Thus, only the edge pixel unit 130 is taken as an example to describe the method for manufacturing the pixel array substrate.

Referring to FIG. 2, the method for manufacturing the pixel array substrate 100 includes steps as follow. A first insulating layer 170*a* is formed on the substrate 110, and then the gates 134*a* of the edge pixel units 130 and the conductive pattern 140 are formed on the first insulating layer 170*a*. After that, a second insulating layer 170*b* is formed to cover the gates 134*a* of the edge pixel units 130 and the conductive pattern 140. Then, a channel layer 134*d* and the source/drain 134*b*/134*c* are formed above the gate 134*a* in turn, so as to form the active element 134.

After that, a protective layer 180 is formed to cover the active elements 134 and the conductive pattern 140, and a third insulating layer is formed on the protective layer 180. Then, a first contact window 180*a* is formed in film layers (e.g. the protective layer 180 and the third insulating layer 170*c*) above the drain 134*c* so as to partially expose the drain 134*c*, and a second contact window 180*b* is formed in films layers (e.g. the second insulating layer 170*b*, the protective layer 180 and the third insulating layer 170*c*) above the conductive pattern 140 so as to partially expose the conductive pattern 140. Afterwards, the pixel electrode 135 and the passive electrode 150 are formed. The pixel electrode 135 is electrically connected to the active element 134 through the first contact window 180*a*. The passive electrode 150 is electrically connected to the conductive pattern 140 through the second contact window 180*b*.

Figure 3:
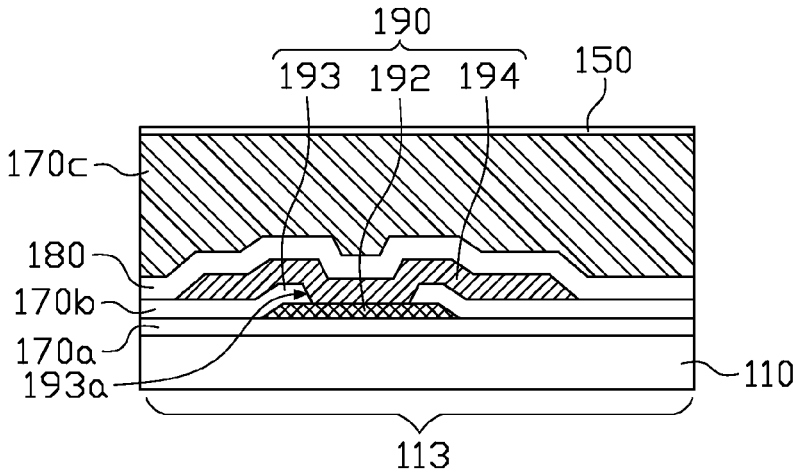
FIG. 3 is a schematic cross-sectional view taken along line III-III of FIG. 1.

FIG. 3 is a schematic cross-sectional view taken along line III-III of FIG. 1. Referring to FIGS. 1 and 3, the pixel array substrate 100 further includes at least one electrostatic protection element 190 disposed in the sub-display area 113. In this embodiment, each scanning line 132 and each data line 133 are respectively connected to the electrostatic protection element 190. FIG. 3 shows that electrostatic protection element 190 includes a first conducting layer 192, a first dielectric layer 193 and a second conducting layer 194. The first conducting layer 192 is disposed on the substrate 110. In details of this embodiment, the first conducting layer 192 is disposed on the first insulating layer 170*a* which covers the substrate 110. The first dielectric layer 193 covers the first conducting layer 192 and defines a third contact window 193*a* to partially expose the first conducting layer 192. In this embodiment, the first conducting layer 192, the gates 134*a* and the conductive pattern 140 are, for example, formed in a same process. The first dielectric layer 193 and the second insulating layer 170*b* of FIG. 2 are, for example, located at a same layer and formed in a same process. The second conducting layer 194 is disposed on the first dielectric layer 193 and is electrically connected to the first conducting layer 192 through the third contact window 193*a*. In this embodiment, the second conducting layer 194, the source 134*b* and the drain 134*c* are, for example, formed in a same process.

Further, the scanning lines 132 in the main display area 112 are, for example, electrically connected to the first conducting layer 192 of the electrostatic protection element 190. In this embodiment, the electrostatic protection element 190 leads out the static electricity of the main display area 112 through the second conducting layer 194 which is electrically connected to the first conducting layer 192, so as to prevent the active element 134 in the main display area 112 from being damaged by accumulation of the static electricity.

Specially, in this embodiment, the protective layer 180 and the third insulating layer 170*c* may be formed above the electrostatic protection element 190 in turn, and the passive electrode 150 is then formed on the third insulating layer 170*c*. Moreover, the thickness of the third insulating layer 170*c* can be increased to avoid the static electricity affecting the potential of the passive electrode 150. In addition, in this embodiment, the passive electrode 150 disposed in the sub-display area 113 covers the electrostatic protection element 190 and the conductive pattern 140. In another embodiment, the passive electrode 150 may, without limitation, cover the driving circuit 160 or other line disposed on the sub-display area 113, e.g., common electrode line.

Figure 4:
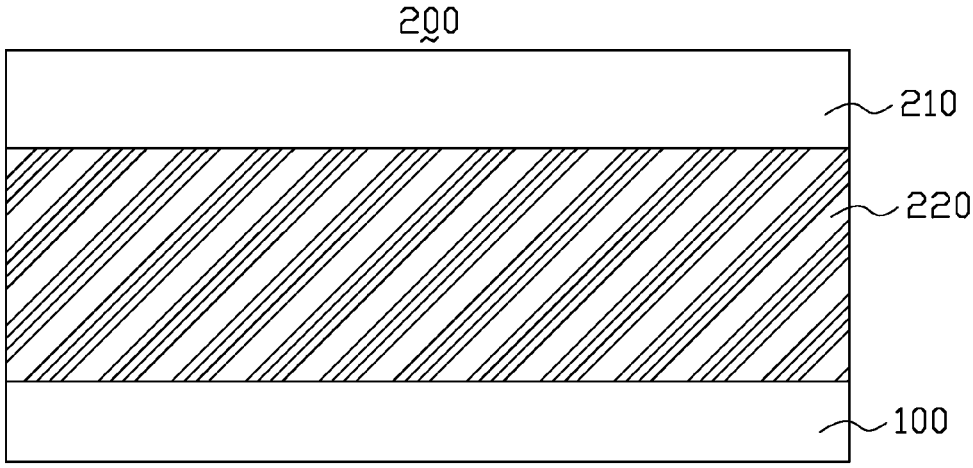
FIG. 4 is a schematic view of a display panel according to an embodiment of the present disclosure.

FIG. 4 is a schematic view of a display panel according to an embodiment of the present disclosure. Referring to FIG. 4, the display panel 200 includes the pixel array substrate 100, a transparent substrate 210 and a display medium layer 220. The transparent substrate 210 may be, without limitation, a color filter, and is disposed above the pixel array substrate 100. The display medium layer 220 is disposed between the pixel array substrate 100 and the transparent substrate 210. The display medium layer 220 may be, without limitation, a liquid crystal display layer or an electrophoretic display layer. In addition, the electrophoretic display layer may be, without limitation, microcapsule-type electrophoretic display layer or microcup-type electrophoretic display layer.

Since the driving circuit 160 can output the edge pixel signals to the edge pixel units 130 and to the passive electrode 150 through the conductive pattern 140 at the same time, the passive electrode 150 can control the display content at edges of the display medium layer 220 above the passive electrode 150. This is beneficial to expand the display area of the display panel 200.

In summary, the pixel array substrate and the display panel of the embodiments of the present disclosure at least have following advantages.

First, according to the pixel array substrate and the display panel of the embodiments of the present disclosure, the passive electrode is electrically connected to the driving circuit through the conductive pattern, so as to receive the signal that the driving circuit transmits to the edge pixel units. Thus, the passive electrode disposed on the sub-display area also can capture the signal of the appointed pixels, so as to expand the display area.

Second, according to the display panel of the embodiments of the present disclosure, when the main display area of the display panel is an irregular rectangle, the passive electrode may be disposed on irregular blocks at edges of the main display area. Thus, the irregular blocks at edges of the main display area also can show images. As said above, the display panel applies a simple configuration to expand the display area, which can save cost.

In one embodiment of the present disclosure, the pixel array substrate includes at least one electrostatic protection element, and the insulating layer has the suitable thickness to separate the electrostatic protection element from the passive electrode. This can avoid the static electricity from the main display area to the electrostatic protection element affecting the potential of the passive electrode.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A pixel array substrate, comprising:

a substrate including a main display area and a sub-display area around the main display area;

a plurality of center pixel units arrayed in the main display area;

a plurality of edge pixel units arrayed in the main display area and around the center pixel units;

at least one passive electrode disposed in the sub-display area and surrounding the edge pixel units;

a driving circuit disposed in the sub-display area and electrically connected to the edge pixel units; and at least one conductive pattern disposed in the sub-display area and electrically connected to the at least one passive electrode and the driving circuit respectively, wherein the driving circuit is configured to output a plurality of edge pixel signals to the edge pixel units and the at least one passive electrode.

2. The pixel array substrate according to claim 1, further comprising a plurality of scanning lines and a plurality of data lines, wherein the scanning lines and the data lines are formed in the main display area and define a plurality of pixel regions in the main display area, the center pixel units and the edge pixel units are disposed in the pixel regions respectively, and each edge pixel unit includes:

an active element disposed adjacent to an intersection of the corresponding scanning line and the corresponding data line, the active element being electrically connected to the corresponding scanning line and the corresponding data line; and a pixel electrode electrically connected to the active element.

3. The pixel array substrate according to claim 2, further comprising an insulating layer, wherein the insulating layer covers the active elements and the at least one conductive pattern, the pixel electrodes and the at least one passive electrode are disposed on the insulating layer, the insulating layer defines a plurality of first contact windows and at least one second contact window, each active element is partially exposed from the corresponding first contact window, the at least one conductive pattern is partially exposed from the at least one second contact window, the pixel electrodes are respectively electrically connected to the active elements through the first contact windows, and the passive electrode is electrically connected to the at least one conductive pattern through the at least one second contact window.

4. The pixel array substrate according to claim 2, wherein a material of the at least one passive electrode is the same with that of the pixel electrodes.

5. The pixel array substrate according to claim 2, wherein the at least one conductive pattern is formed with the scanning lines in a same process.

6. The pixel array substrate according to claim 1, further comprising at least one electrostatic protection element disposed in the sub-display area, wherein the at least one electrostatic protection element is electrically connected to the center pixel units and the edge pixel units.

7. The pixel array substrate according to claim 6, wherein the at least one electrostatic protection element comprises:

a first conducting layer disposed on the substrate;

a first dielectric layer covering the first conducting layer and having a third contact window to partially expose the first conducting layer; and a second conducting layer disposed on the first dielectric layer and electrically connected to the first conducting layer through the third contact window.

8. The pixel array substrate according to claim 7, further comprising an insulating layer, wherein the insulating layer covers the second conducting layer, and the at least one passive electrode is disposed on the insulating layer.

9. The pixel array substrate according to claim 6, wherein the at least one passive electrode covers the driving circuit and the electrostatic protection element.

10. A display panel, comprising:

a pixel array substrate, including:

a substrate including a main display area and a sub-display area around the main display area;

a plurality of center pixel units arrayed in the main display area;

a plurality of edge pixel units arrayed in the main display area and around the center pixel units;

at least one passive electrode disposed in the sub-display area and surrounding the edge pixel units;

a driving circuit disposed in the sub-display area and electrically connected to the edge pixel units; and at least one conductive pattern disposed in the sub-display area and electrically connected to the at least one passive electrode and the driving circuit respectively, wherein the driving circuit is configured to output a plurality of edge pixel signals to the edge pixel units and the at least one passive electrode;

a transparent substrate disposed above the pixel array substrate; and a display medium layer disposed between the pixel array substrate and the transparent substrate.

11. The display panel according to claim 10, wherein the pixel array substrate further comprises a plurality of scanning lines and a plurality of data lines, the scanning lines and the data lines are formed in the main display area and define a plurality of pixel regions in the main display area, the center pixel units and the edge pixel units are respectively disposed in the pixel regions, and each edge pixel unit includes:

an active element disposed adjacent to an intersection of the corresponding scanning line and the corresponding data line, the active element being electrically connected to the corresponding scanning line and the corresponding data line; and a pixel electrode electrically connected to the active element.

12. The display panel according to claim 11, wherein the pixel array substrate further comprises an insulating layer, the insulating layer covers the active elements and the at least one conductive pattern, the pixel electrodes and the at least one passive electrode are disposed on the insulating layer, the insulating layer defines a plurality of first contact windows and at least one second contact window, each active element is partially exposed from the corresponding first contact window, the at least one conductive pattern is partially exposed from the at least one second contact window, the pixel electrodes are respectively electrically connected to the active elements through the first contact windows, and the passive electrode is electrically connected to the at least one conductive pattern through the at least one second contact window.

13. The display panel according to claim 11, wherein a material of the at least one passive electrode is the same with that of the pixel electrodes.

14. The display panel according to claim 10, wherein the pixel array substrate further comprises at least one electrostatic protection element disposed in the sub-display area and electrically connected to the center pixel units and the edge pixel units.

15. The display panel according to claim 14, wherein the at least one electrostatic protection element comprises:

a first conducting layer disposed on the substrate;

a first dielectric layer covering the first conducting layer, the first dielectric layer defining a third contact window to partially expose the first conducting layer; and a second conducting layer disposed on the first dielectric layer and electrically connected to the first conducting layer through the third contact window.

16. The display panel according to claim 15, wherein the pixel array substrate further comprises an insulating layer, the insulating layer covers the second conducting layer, and the at least one passive electrode is disposed on the insulating layer.

17. The display panel according to claim 14, wherein the at least one passive electrode covers the driving circuit and the electrostatic protection element.

* * * * *